US007384100B2

(12) United States Patent
Perry et al.

(10) Patent No.: US 7,384,100 B2
(45) Date of Patent: Jun. 10, 2008

(54) FLEXIBLE RECLINING CHAIR

(75) Inventors: Charles O. Perry, East Norwalk, CT (US); Marco C. Perry, 501 Hicks St., Apt. 106, Brooklyn, NY (US) 11231

(73) Assignee: Marco C. Perry, Brooklyn, NY (US)

( * ) Notice: Subject to any disclaimer, the term of this patent is extended or adjusted under 35 U.S.C. 154(b) by 207 days.

(21) Appl. No.: 11/123,594

(22) Filed: May 6, 2005

(65) Prior Publication Data

US 2005/0264072 A1 Dec. 1, 2005

Related U.S. Application Data

(60) Provisional application No. 60/568,946, filed on May 6, 2004.

(51) Int. Cl.
*A47C 3/00* (2006.01)

(52) U.S. Cl. ..... 297/286; 297/294; 297/287; 297/285; 297/300.1; 297/300.4

(58) Field of Classification Search ..... 297/286, 297/294, 300.1, 300.4, 302.3, 259.2, 268.2, 297/451.7, 287, 296, 285
See application file for complete search history.

(56) References Cited

U.S. PATENT DOCUMENTS 787,299 A * 4/1905 Koeser ..... 248/625
1,377,600 A 5/1921 Prest
2,704,567 A 3/1955 Anderegg
4,618,185 A 10/1986 Kaufman
4,787,672 A 11/1988 Werner
5,112,107 A * 5/1992 Doughty ..... 297/288
RE36,335 E 10/1999 Perry
D422,805 S 4/2000 Smith
D423,242 S 4/2000 Lin
D478,748 S 8/2003 Liu
7,073,864 B2 * 7/2006 Olsen ..... 297/447.1

* cited by examiner

*Primary Examiner*—Laurie K Cranmer
(74) *Attorney, Agent, or Firm*—DLA Piper US LLP

(57) ABSTRACT

A flexible chair that includes a seat member with seat bottom and back rest portions, first and second pairs of legs, and a plurality of cross members. The pair of first legs are pivotly connected to rearward positions of the seat bottom portion and extend downwardly and forwardly from the seat bottom portion. The pair of second legs are pivotly connected to forward positions of the seat bottom portion and extend downwardly and rearwardly from the seat bottom portion, such that the first legs cross the second legs. The plurality of cross members connect the first and second legs together such that the seat member is rearwardly reclinable against a resilient force provided by at least one of the first pair of legs, the second pair of legs and the plurality of cross members.

15 Claims, 6 Drawing Sheets

FLEXIBLE RECLINING CHAIR

This application claims the benefit of U.S. Provisional Application No. 60/568,946, filed May 6, 2004.

FIELD OF THE INVENTION

The present invention relates to chairs, and more particularly to stackable, reclining chairs that combine functionality and comfort.

BACKGROUND OF THE INVENTION

It is presently known to make a chair that flexes, where as the back tilts, the seat travels forward and slightly upward. Such a chair is disclosed in U.S. Pat. Re. 36,335.

However, such a chair does not have arm rests, and does not provide a simple construction that allows the chair to resiliently recline in a hammock-like fashion, while still being stackable.

SUMMARY OF THE INVENTION

The present invention is a reclining chair that provides a seat back and bottom that tilts in a hammock like fashion through flexure of the legs and/or cross members between the legs, without the bottom of the legs moving, and without using springs or other complicated or expensive mechanical devices.

A flexible chair that includes a seat member having a seat bottom portion and a back rest portion, a pair of first legs pivotly connected to rearward positions of the seat bottom portion and extending downwardly and forwardly from the seat bottom portion, a pair of second legs pivotly connected to forward positions of the seat bottom portion and extending downwardly and rearwardly from the seat bottom portion such that the first legs cross the second legs, and a plurality of cross members connecting the first and second legs together such that the seat member is rearwardly reclinable against a resilient force provided by at least one of the first pair of legs, the second pair of legs and the plurality of cross members.

In another aspect of the present invention, a flexible chair includes a seat member having a seat bottom portion and a back rest portion, a pair of arm rests extending up from the seat bottom portion, a pair of first legs pivotly connected to rearward positions of the arm rests and extending downwardly and forwardly from the arm rests, a pair of second legs pivotly connected to forward positions of the arm rests and extending downwardly and rearwardly from the arm rests, such that the first legs cross the second legs, and a plurality of cross members connecting the first and second legs together such that the seat member is rearwardly reclinable against a resilient force provided by at least one of the first pair of legs, the second pair of legs and the plurality of cross members.

Other objects and features of the present invention will become apparent by a review of the specification, claims and appended figures.

DETAILED DESCRIPTION OF THE PREFERRED EMBODIMENTS

Figure 1:
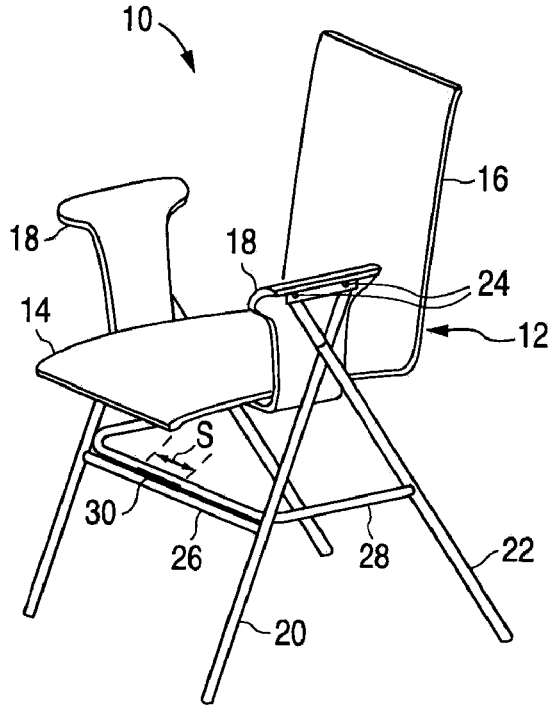
FIG. 1 is a perspective view of the flexible chair of the present invention.

The present invention is a chair 10 that is illustrated in FIG. 1. The chair includes a seat member 12 having a seat bottom portion 14 and a back rest portion 16 either integrally formed together (as shown), rigidly attached to each other, or attached together in an articulatable manner. The seat member 12 includes arm rests 18 that, in the preferred embodiment, are attached to and support the seat bottom portion 14. A forward leg 20 and rearward leg 22 are connected to each of the arm rests 18, and extend down from the arm rest 18 in a manner where the forward and rearward legs 20/22 cross each other. Thus, the forward leg 20 is pivotally connected (i.e. in a rotatable manner such as with a rotating pin joint 24) to a rearward position of the arm rest 18 (i.e. closer to the back rest portion 16) and extends therefrom in forward and downward directions. Likewise, the rearward leg 22 is pivotally connected (i.e. in a rotatable manner such as with a rotating pin joint 24) to a forward position of the arm rest 18 (i.e. a position further forward relative to the back rest portion 16 compared to the rearward position of the other pin joint) and extends therefrom in rearward and downward directions. A first cross member 26 extends between and is rigidly attached to the pair of forward legs 20. A second cross member 28 extends between and is rigidly attached to the pair of rearward legs 22, and is formed in a U-shape that extends forward from the rearward legs 22 to a weld point 30 where it is welded or otherwise connected to the first cross member 26. The weld point 30 preferably encompasses a relatively short segment "S" of the cross members 26/28 (e.g. 4 to 6 inches), but can be extended or shortened to result in the desired amount of these cross members that are not connected together and thus can flex independently.

Figure 2:
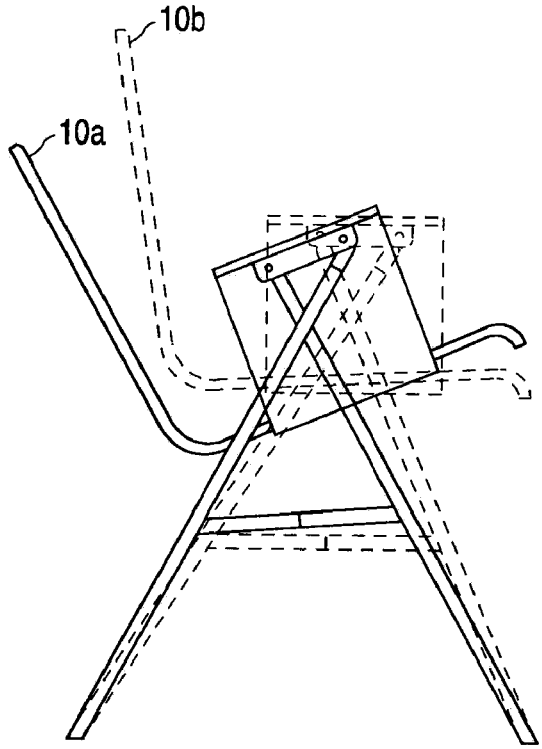
FIG. 2 is a side view of the flexible chair of the present invention, illustrating how the seat member reclines backward against the resiliency of the legs and cross members.
Figure 3:
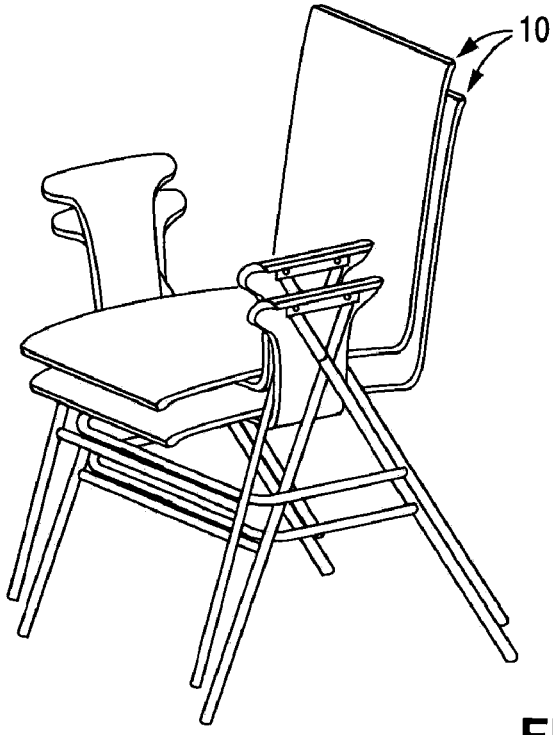
FIG. 3 is a perspective view illustrating the stacking of the flexible chair of the present invention.

When a person sits on the seat bottom portion 14 and leans back against the back rest portion 16 (i.e. shifts the center of gravity backward on bottom seat portion 14 and/or exerts a backward force against the back rest portion 16), all four legs 20/22 rotate rearwardly as the seat member reclines into its occupied position 10*a* (relative to its resting unoccupied position 10*b*) as illustrated in FIG. 2, in which the cross members 26/28 twist and/or flex together and separately to resiliently counter the tilting back of the seat member 12. When the person vacates the chair 10, seat member 12 is resiliently brought back into its static resting position 10*b* as the cross members 26/28 untwist and/or unflex. The portions of the first cross member 26 not connected to the second cross member 28 twist in torsion, and the second cross member 28 is subjected to a mix of torsion and bending. The stiffness of the chair 10 (against the rearward tilt) is set by the rigidity of cross members themselves, as well as what proportion of the cross members 26/28 are left unconnected to each other for independent twisting/flexing. Thus, increasing the distance S where the first and second cross members 26/28 are joined increases the stiffness of the chair. The chairs 10 can be stacked for easy storage, as shown in FIG. 3. Chair stacking is facilitated by making the forward legs 20 positioned inside of the rearward legs 22, and by making the second cross member 28 wider (at the point adjacent the forward legs 20) than the distance between the forward legs 20, so that the second cross member 28 nests outside of the forward legs 20 of the chair below it.

Figure 4:
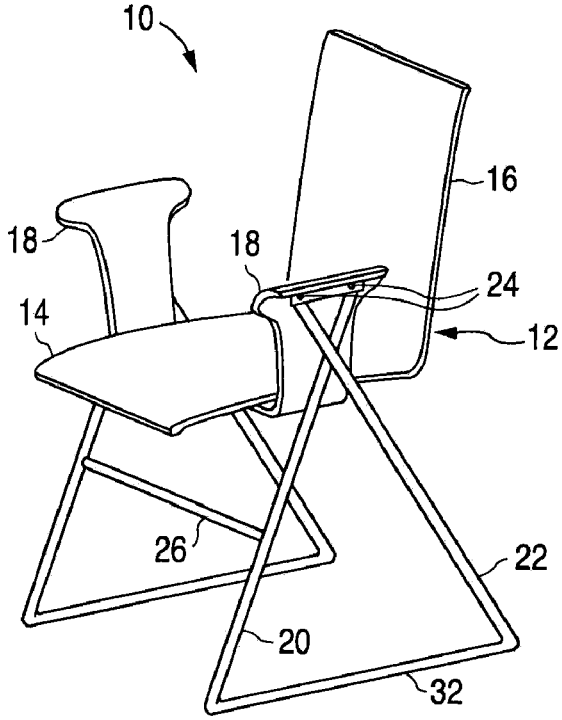
FIG. 4 is a perspective view of an alternate embodiment of the flexible chair of the present invention.
Figure 5:
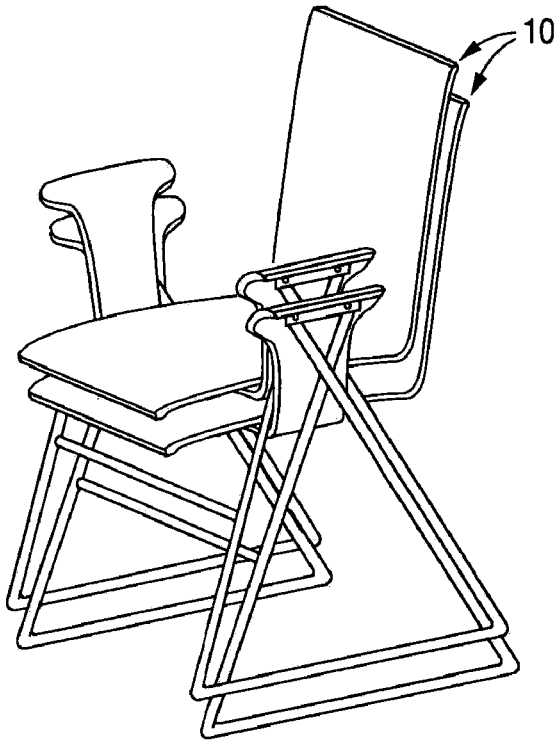
FIG. 5 is a perspective view illustrating the stacking of the flexible chair illustrated in FIG. 4.

FIG. 4 illustrates an alternate embodiment of the present invention, where the bottoms of each corresponding pair of forward/rearward legs 20/22 are joined together by a bottom cross-member 32. Preferably, each pair of corresponding forward/rearward legs 20/22 and its bottom cross-member 32 are integrally formed together. In this embodiment, the second cross-member 28 is (but need not be) omitted, where the flexure of the legs 20/22 (especially where they meet the bottom cross-member 32) provides most of the chair's resiliency. It should be noted that the first cross member 26 could be omitted as well, so long as the legs 20/22 are adequately and firmly secured to the arm rests 18. The bottom cross-members 32 allow the chair to be easily slid forwardly/rearwardly along a surface (e.g. a carpeted surface), and allow the chair 10 to be stacked as illustrated in FIG. 5.

Figure 6A:
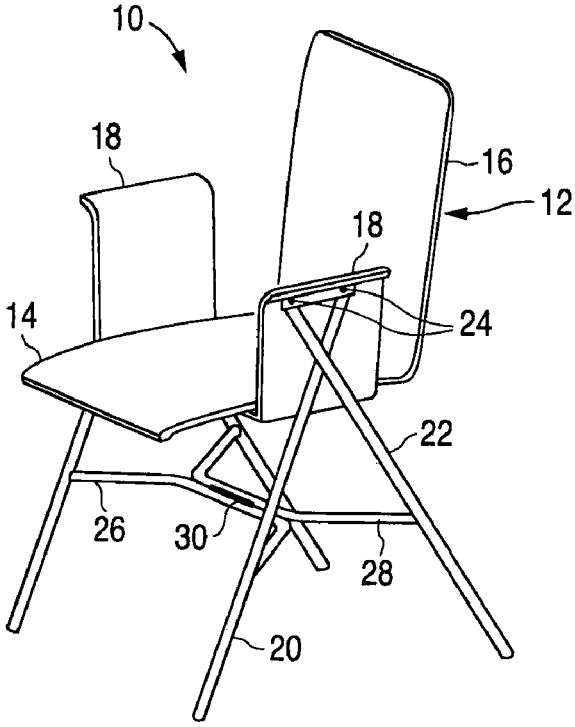
FIG. 6A is a perspective view illustrating an alternate configuration of the cross members for the flexible chair of the present invention.
Figure 6B:
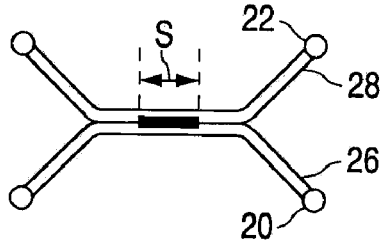
FIG. 6B is a top cross-sectional view illustrating the alternate configuration of the cross members of FIG. 6A.
Figure 7A:
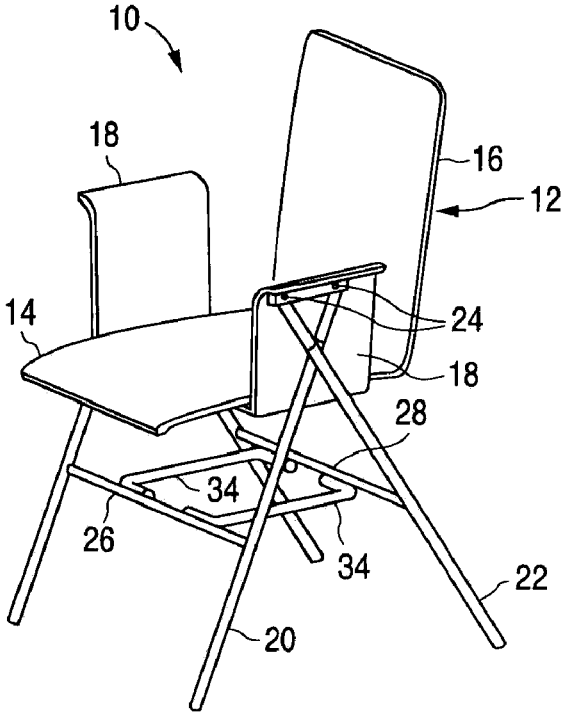
FIG. 7A is a perspective view illustrating an alternate configuration of the cross members for the flexible chair of the present invention.
Figure 7B:
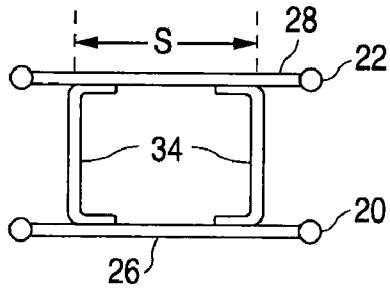
FIG. 7B is a top cross-sectional view illustrating the alternate configuration of the cross members of FIG. 7A.
Figure 8:
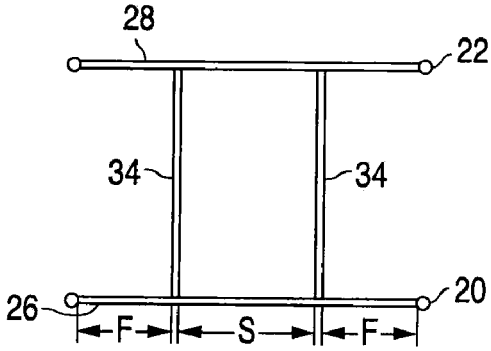
FIG. 8 is a top cross-sectional view illustrating the relative positioning of the cross members for the flexible chair of the present invention.
Figure 9:
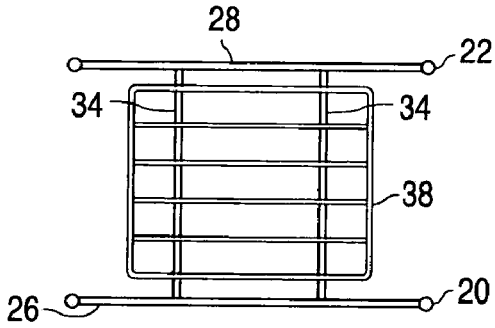
FIG. 9 is a top cross-sectional view illustrating a bookshelf mounted on the cross members.
Figure 10:
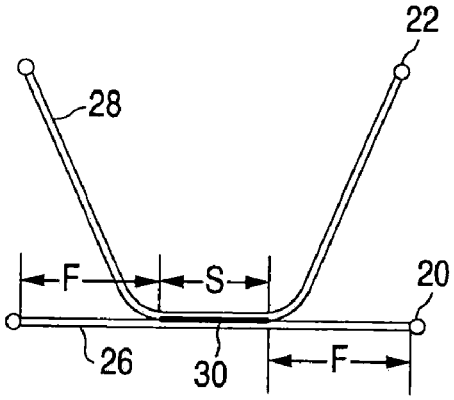
FIG. 10 is a top cross-sectional view illustrating the various dimensions of the cross members.
Figure 11:
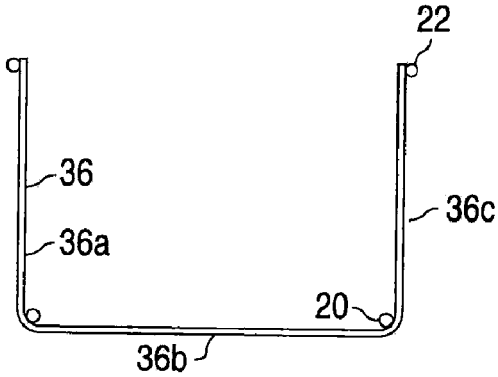
FIG. 11 is a top cross-sectional view illustrating an alternate configuration of the cross members for the flexible chair of the present invention.

It is within the scope of the present invention to incorporate different configurations of the first and/or second cross-members 26/28 and the weld point(s) 30 (if any) therebetween to achieve the desired tilting action of the seat member 12 and the stackability of the chairs. For example, FIG. 6 illustrates that the first and second cross members 26/28 both bend inwardly toward each other (i.e. both are non-linear). FIG. 7 illustrates that the first and second cross members 26/28 extend straight between the legs, and are attached together via a pair of torsion bars 34 extending therebetween separated by the distance "S". When the user reclines in the chair, the portions of the cross members 26/28 between the torsion bars 34 are rigid, and the portions of the cross members 26/28 between the torsion bars 24 and the legs 20/22 flex and/or twist. Thus, the greater the distance between the torsion bars 34, the stiffer the chair. FIG. 8 illustrates that first and second torsion bars 34 are connected between the first and second cross members 26/28 and are separated by a distance S. Lengths F of the first and second cross members 26/28 bend in pure torsion when the seat member 12 reclines. Increasing the lengths F will soften (reduce the force needed to recline) the chair, which can be achieved by decreasing the spacing S. In FIG. 9, a bookshelf 38 (formed of crisscrossing bars) is supported by the first and second torsion bars 34 of FIG. 8, for institutional seating applications. In FIG. 10, the second cross member 28 is angled inwardly further than that shown in FIG. 1. The longer length of the second cross member 28 as compared to other embodiments reduces the strain on the second cross member 28. The first cross member 26 twists in pure torsion in the length portions F. This configuration can be used for aesthetic reasons and potentially to reduce the stress on the cross members 26/28 and their connections, and may make stacking more difficult. In FIG. 11, there is just a single U-shaped crossbar 36 that forms the three cross member segments 36*a*, 36*b*, 36*c* connecting all four legs. The rearward legs are wider than the crossbar 36, and the U-shaped crossbar 36 is wider than the forward legs. This configuration requires only one crossbar or member, which may place more stress on the joints of the crossbar, and the legs may be designed to bend to compensate for the extra stiffness of the connections.

Figure 12:
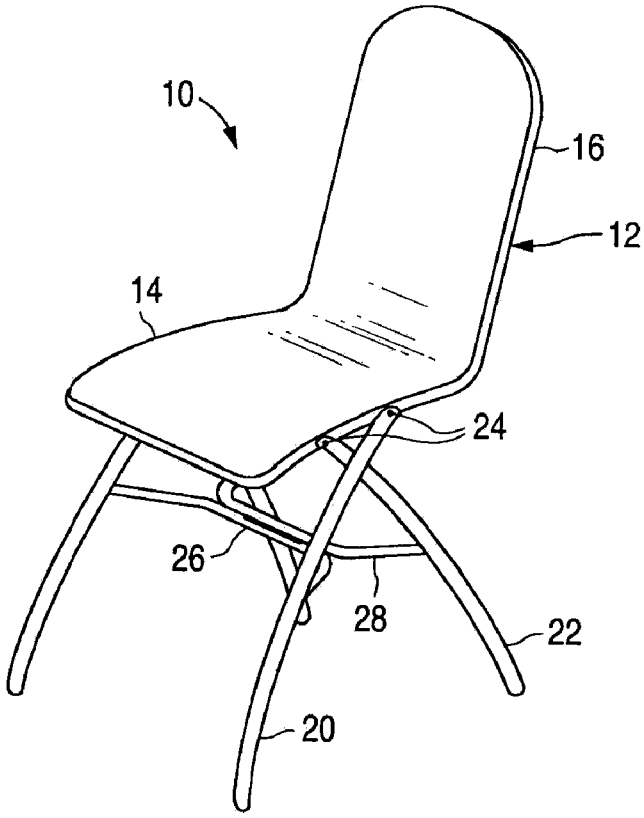
FIG. 12 is a perspective view of the flexible chair of the present invention without arm rests.
Figure 13:
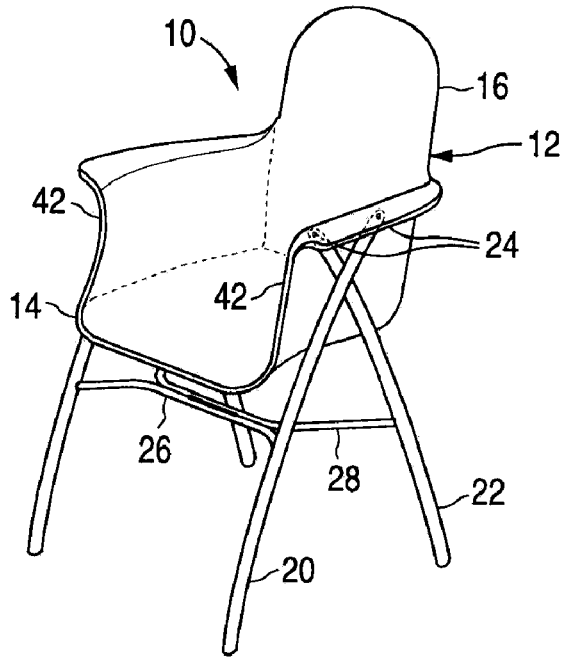
FIG. 13 is a perspective view of the flexible chair of the present invention with a bucket shaped seat member.
Figure 14:
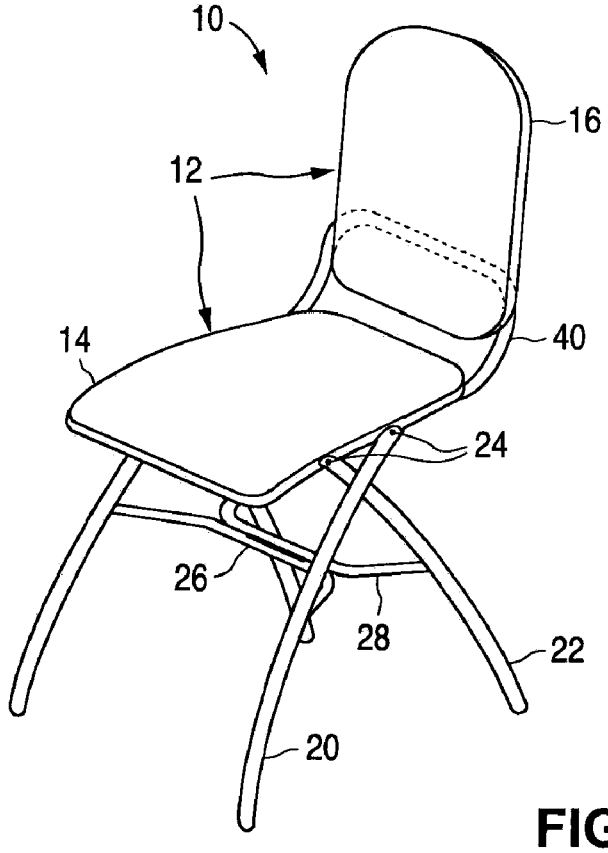
FIG. 14 is a perspective view of the flexible chair of the present invention with the back rest portion rotatably connected to the seat bottom portion.

It is to be understood that the present invention is not limited to the embodiment(s) described above and illustrated herein, but encompasses any and all variations falling within the scope of the appended claims. For example, cross member segments 36*a*, 36*b*, 36*c* could be three separate segments connected together, instead of a single integrally formed crossbar member, and further segment 36*b* can be omitted if there is sufficient stability for the intended application without it. The arm rests 18 can be omitted from the seat bottom portion 14, where the pin joints 24 pivotly connect the legs 20/22 to the sides of seat bottom portion 14, as illustrated in FIG. 12. Seat member 12 can be integrally formed in a bucket seat shape as illustrated in FIG. 12, where the seat bottom portion 14 includes side members 42 extending up to serve as arm rests, and where the seat bottom portion 14, side members 42 and back rest portion 16 are all integrally formed together. Lastly, back rest portion 16 can be pivotly attached to the seat bottom portion using a separate bar member 40 (that is attached to seat bottom portion 14 and rotatably attached to the back rest portion 16), as illustrated in FIG. 14.

What is claimed is:

1. A flexible chair, comprising:

a seat member having a seat bottom portion and a back rest portion;

a pair of first legs pivotly connected to rearward positions of the seat bottom portion and extending downwardly and forwardly from the seat bottom portion;

a pair of second legs pivotly connected to forward positions of the seat bottom portion and extending downwardly and rearwardly from the seat bottom portion, such that the first legs cross the second legs; and a plurality of cross members connecting the first and second legs together such that the seat member is rearwardly reclinable against a resilient force provided by at least one of the first pair of legs, the second pair of legs and the plurality of cross members;

wherein the plurality of cross members includes:

a first cross member extending between the first legs; and a second cross member extending between the second legs;

wherein mid portions of the first and second cross members are rigidly connected together.

2. The flexible chair of claim 1, wherein the seat bottom portion and the back rest portion are integrally formed together.

3. The flexible chair of claim 1, wherein the seat bottom portion and the back rest portion are rotatably connected together.

4. The flexible chair of claim 1, wherein the seat bottom portion includes:

a pair of arm rests extending up from the seat bottom portion.

5. The flexible chair of claim 4, wherein:

the pivot connection between the pair of first legs and the seat bottom portion are disposed on rearward positions of the arm rests;

the pivot connection between the pair of second legs and the seat bottom portion are disposed on forward positions of the arm rests.

6. The flexible chair of claim 1, wherein:

one of the first and second cross members is substantially straight; and the other one of the first and second cross members is U-shaped.

7. The flexible chair of claim 1, wherein the first and second cross members are both non-linear.

8. The flexible chair of claim 1, wherein the first pair of legs are separated from each other by distance less than that separating the second pair of legs from each other.

9. A flexible chair, comprising:

a seat member having a seat bottom portion and a back rest portion;

a pair of first legs pivotly connected to rearward positions of the seat bottom portion and extending downwardly and forwardly from the seat bottom portion;

a pair of second legs pivotly connected to forward positions of the seat bottom portion and extending downwardly and rearwardly from the seat bottom portion, such that the first legs cross the second legs; and a plurality of cross members connecting the first and second legs together such that the seat member is rearwardly reclinable against a resilient force provided by at least one of the first pair of legs, the second pair of legs and the plurality of cross members;

wherein the plurality of cross members includes:

a first cross member extending between the first legs;

a second cross member extending between the second legs; and a plurality of torsion bars extending between the first and second cross members.

10. The flexible chair of claim 9, further comprising:

a bookshelf of crisscrossing bars disposed over the first and second cross members and the plurality of torsion bars, and under the seat bottom portion.

11. A flexible chair, comprising:

a seat member having a seat bottom portion and a back rest portion;

a pair of first legs pivotly connected to rearward positions of the seat bottom portion and extending downwardly and forwardly from the seat bottom portion;

a pair of second legs pivotly connected to forward positions of the seat bottom portion and extending downwardly and rearwardly from the seat bottom portion, such that the first legs cross the second legs; and a plurality of cross members connecting the first and second legs together such that the seat member is rearwardly reclinable against a resilient force provided by at least one of the first pair of legs, the second pair of legs and the plurality of cross members;

wherein the seat bottom portion includes side members extending upwardly, and wherein the seat bottom portion, the back rest portion and the side members are integrally formed together.

12. A flexible chair, comprising:

a seat member having a seat bottom portion and a back rest portion;

a pair of arm rests extending up from the seat bottom portion;

a pair of first legs pivotly connected to rearward positions of the arm rests and extending downwardly and forwardly from the arm rests;

a pair of second legs pivotly connected to forward positions of the arm rests and extending downwardly and rearwardly from the arm rests, such that the first legs cross the second legs; and a plurality of cross members connecting the first and second legs together such that the seat member is rearwardly reclinable against a resilient force provided by at least one of the first pair of legs, the second pair of legs and the plurality of cross members.

13. The flexible chair of claim 12, wherein the plurality of cross members includes:

a first cross member extending between the first legs; and a second cross member extending between the second legs;

wherein mid portions of the first and second cross members are rigidly connected together.

14. The flexible chair of claim 13, wherein the first and second cross members are both non-linear.

15. The flexible chair of claim 12, wherein the plurality of cross members includes:

a first cross member extending between the first legs;

a second cross member extending between the second legs; and a plurality of torsion bars extending between the first and second cross members.

* * * * *